United States Patent [19]

Schneider et al.

[11] 3,958,598

[45] May 25, 1976

[54] HIGH PRESSURE, 4-POSITION, 5-WAY, PILOT OPERATED VALVE FOR CORROSIVE MEDIA

[75] Inventors: William E. Schneider, Annapolis; John A. Sasse, Stevensville, both of Md.

[73] Assignee: The United States of America as represented by the Secretary of the Navy, Washington, D.C.

[22] Filed: Mar. 25, 1975

[21] Appl. No.: 561,964

[52] U.S. Cl. ..... 137/596.18; 114/16 E

[51] Int. Cl.[2] ..... B63G 8/22

[58] Field of Search ..... 114/16 E; 137/596.14, 137/596.15, 596.16, 596.18

[56] References Cited

UNITED STATES PATENTS 3,243,958 4/1966 Ruchser ..... 91/459 X 3,460,614 8/1969 Burgess ..... 137/596 X

*Primary Examiner*—Alan Cohan
*Assistant Examiner*—Gerald A. Michalsky
*Attorney, Agent, or Firm*—R. S. Sciascia; Q. E. Hodges; D. McGiehan

[57] ABSTRACT

A pilot hydrauic fluid pressure operated valve having the function of a 4-position 5-way valve for controlling the flow of high pressure corrosive media in a high pressure environment such as the deep ocean. The valve body contains two double-ended axially aligned poppet pistons each of which comprise a large pilot actuated piston in the center of the "spool" and each of which have a valve poppet at each end of the "spool" for control of the media which may be sea water ballast of a deep submergence vehicle for example.

6 Claims, 2 Drawing Figures

HIGH PRESSURE, 4-POSITION, 5-WAY, PILOT OPERATED VALVE FOR CORROSIVE MEDIA

The invention described herein may be manufactured and used by or for the Government of the United States of America for governmental purposes without the payment of any royalties thereon or therefor.

BACKGROUND OF THE INVENTION

The instant invention relates generally to pilot pressure operated multi-way valves and more particularly to a double-piston, 4-position, 5-way valve for controlling the flow of high pressure corrosive media in a high pressure environment.

Multi-way valves are widely used in hydraulic and pneumatic systems for performing a variety and plurality of coordinated valving functions. Prior art valves however apparently render only 4-way control using 2-position double poppet valves. Also prior art pilot valves are available for handling high pressure media, however there are none, to the knowledge of the applicant that will handle high pressure media in a high pressure environment that is leak tight. Further, many of the multi-way valves are cumbersome and complex in design and in operation to perform their multi-way operation. Prior art valves suffer a lack of reliability when used in a high pressure environment such as is encounted in a ballasting system for a deep submergence vehicle for example. Further in some applications, four or five 2-position, 2-way valves have to be used where the instant valve invention would suffice and be more convenient. Also existing designs of multi-way valves are subject to fouling due to foreign material such as silt getting into the moving parts of the valve.

SUMMARY OF THE INVENTION

Accordingly, an object of the instant invention is to provide a new and improved multi-way pilot pressure operated valve.

Another object of the present invention is to provide a multi-way pilot pressure operated valve capable of handling high pressure and corrosive media in a high pressure environment.

A further object of the instant invention is to provide a pilot pressure operated valve having the function of a 5-way valve with 4-positions.

Still another object of the present invention is to provide a simple, pilot pressure operated, 5-way valve, having two spools or pistons.

Briefly, these and other objects of the present invention are attained by the use of a pilot hydraulic fluid pressure operated valve having two double-ended axially aligned pistons providing 4-positions and thereby 5-way valving action in a valve body. Each piston or "spool" has a pilot pressure actuated piston in the center of the spool, and each has a poppet valve at each end of the "spool".

BRIEF DESCRIPTION OF THE DRAWING

A more complete understanding of the invention and many of the attendant advantages thereto will be appreciated as the same become better understood by reference to the following detailed description when considered in connection with the accompanying drawing, wherein.

DESCRIPTION OF THE PREFERRED EMBODIMENTS

Figure 1:
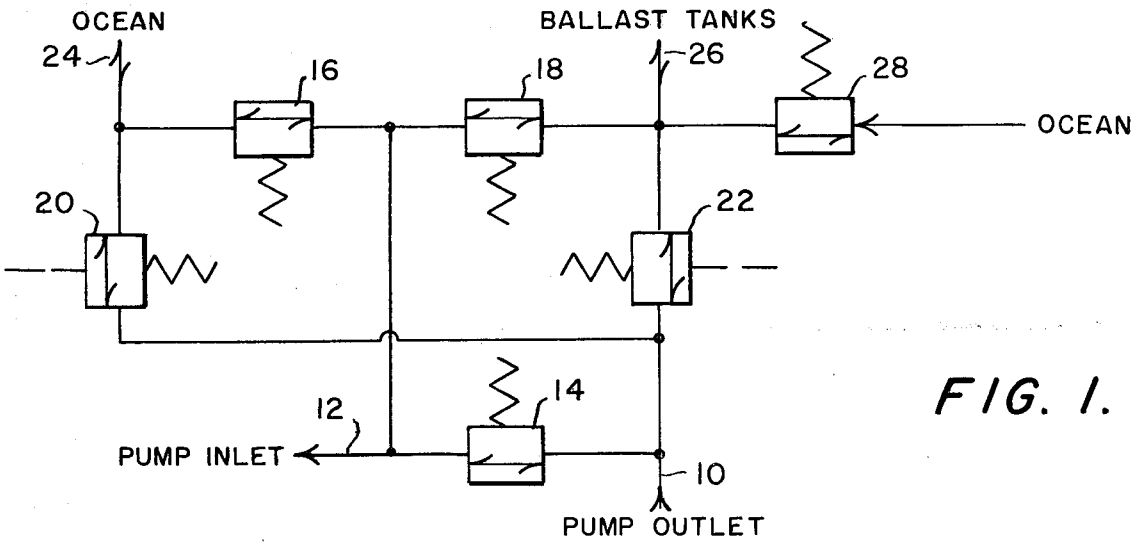
FIG. 1 shows a schematic diagram of an arrangement of six 2-way valves to provide the function of the 4-position 5-way valve according to the invention.

Referring now to the drawings, FIG. 1 represents a schematic drawing of six 2-position, 2-way valves interconnected to be utilized as a 4-position, 5-way valve so as to provide a by-pass, a pump in, and a pump out control function for a ballasting system for example. To provide the by-pass or an open center position, from pump outlet 10 to pump inlet 12 valve 14 is opened, and valves 16, 18, 20, 22, and 28 remain closed. To pump from the ocean inlet 24 to the ballast tanks 26, valves 16 and 22 are opened with valves 18, 20, 28, and 14 kept closed. To deballast or pump out the ballast tanks 26, valves 18 and 20 are opened, and valves 16, 22, 28, and 14 are kept closed. To "free flood" the ballast tank valve 28 is opened and valves 14, 16, 18, 20, and 22 are held closed. The FIG. 1 schematic and the above description is presented to aid in the description and operation of a multi-way valve and body to be described hereinafter.

Figure 2:
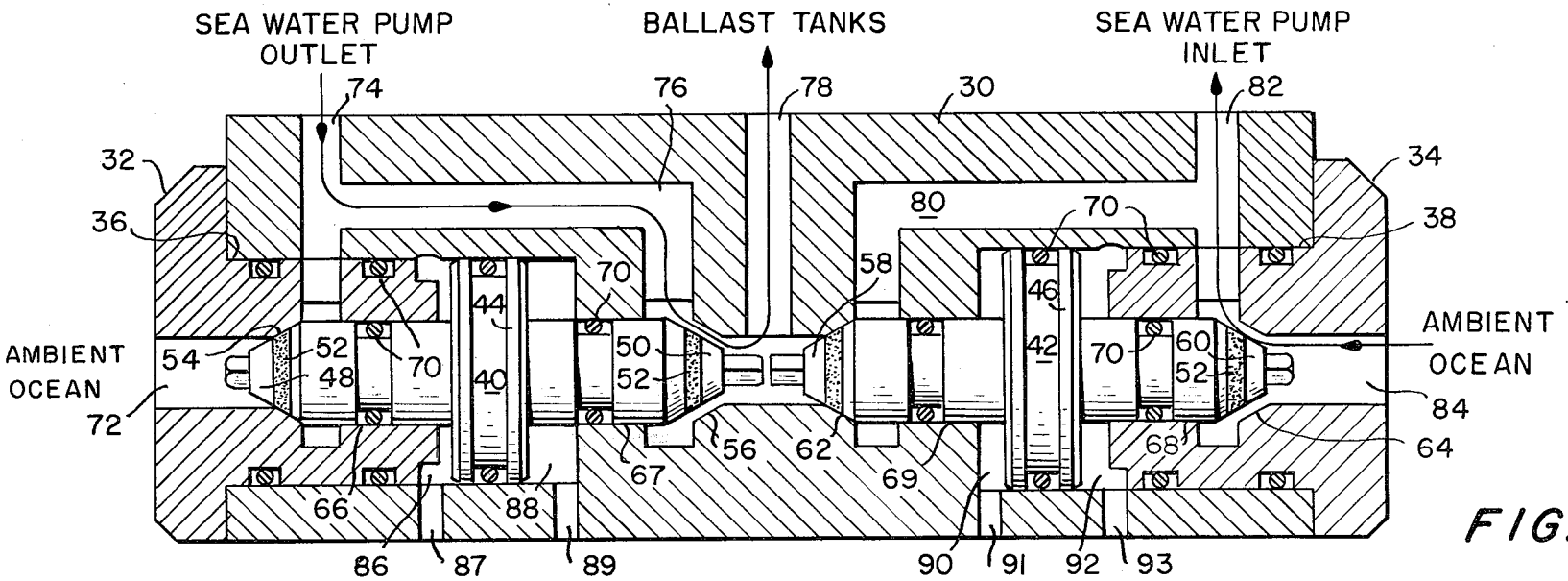
FIG. 2 is a cross-sectional view of the valve according to the invention.

Referring now to FIG. 2, the 4-position 5-way valve according to the invention comprises a body 30 having a pair of end plugs 32 and 34 installed in sealing relationship as with O-rings within the large actuator piston bores 36 and 38 in opposite ends of the body 30. Contained within respective bores 36 and 38 is one of a pair of double-ended poppet pistons or spools 40 and 42 in axial sliding relationship.

Each of spools 40 and 42 includes centrally located relatively large pilot pressure actuated piston 44 and 46 respectively wherein 46 is slightly larger than 44. Each spool is maintained in sliding and sealing relationship within bore 36 and 38 with an O-ring or the like seal. At each end of the spool 40 is a valve poppet 48 on the left end and a valve poppet 50 at the right end which may be in the form of a taper-type valve end. Valve poppets 48 and 50 include a sealing material 52, such as an elastomer "Delrin" or the like, for making a sealing relationship with seats 54, which may also be tapered, formed in end plug 32 and with seat 56 formed in body 30.

Similarly, at the left end of spool 42 is a valve poppet 58 and at the right end a valve poppet 60. Valve poppets 58 and 60 include an elastomeric sealing material 52 making a sealing relationship with seat 62 formed in body 30 and with seat 64 formed in end plug 34. Spool 40 valve poppets slide in poppet guide bores 66 and 67 and are maintained in sealing relationship therewith by O-ring 70, or the like. Similarly, the valve poppets of spool 42, slide in poppet guide bores 68 and 69, and are maintained in sealing relationship therewith by O-rings 70.

Referring to spool 40, the poppet 48 and its seat 54 can open or close an ambient ocean inlet port 72 communicating with a sea water pump outlet port 74. Sea water pump outlet port 74 communicates through a conduit 76 in the body 30 to a ballast tank port 78 through the poppet 50 and its seat 56 which can permit or stop the flow therebetween.

Referring to spool 42, similarly, the poppet 58 and its seat 62 permit or stop the flow from the ballast tank port 78 to a conduit 80 in the body 30 which connects to a sea water pump inlet port 82. Sea water pump inlet port 82 also communicates through poppet 60 and its seat 64 to an ambient ocean inlet port 84, and this flow also can be permitted or interrupted by the position of the spool 42.

The actual operation of the 4-position 5-way pilot valve is provided by pilot hydraulic fluid pressure selectively applied on either side of the pilot pressure actuating piston 44 into pilot pressure cavities 86 or 88, while pilot pressure may also be selectively applied on either side of pilot piston 46 and into cavities 90 and 92. Connected to respective pilot pressure cavities 86, 88, 90, and 92 are pilot pressure port 87, 89, 91, and 93. The pilot pistons 44 and 46 respond by moving to the left or right and not necessarily in unison, but rather independently depending on the control system (not shown.) Therefore, poppet valve 48 may move to the left and close so that poppet valve 50 opens, while simultaneously poppet valve 60 may move to the right so that poppet valve 58 opens. When both spools are shuttled to their inward position the ends of the poppets come in contact with one another and valves 50 and 58 can not simultaneously close (piece 50 contacts piece 58) and since actuating piston 46 has a slightly larger area than actuating piston 44 it is possible to override the actuation of valve spool 40 to close valve 58. When actuated by pilot system of the same pressure, piston 46 generates more force than piston 44. Thus poppet valve 58 seals against its seat 62 while poppet valve 50 is prevented from sealing while valve 48 may be held open by pilot pressure on piston 44. In this manner the ambient ocean port 72 is connected to the ballast tank port via the open poppet valve 48, the conduit 76 in valve body 30 and through the open poppet valve 50. Obviously, this multi-way valve has 4 positions to provide 5-way action.

When the valve is used as a part of a seawater ballasting system, its neutral position is such that hydraulic pressure is applied to cavities 88 and 90, forcing both poppet pistons outwardly, closing both poppet valve 48 and poppet valve 60. The valve is now positioned so that both ambient ocean inlet ports 72 and 84 are blocked. Concomitantly, poppet valves 50 and 58 are both open and therefore the seawater pump inlet port 82 and the seawater pump outlet port 74 are interconnected through the internal valve conduits 76 and 80, and also the ballast tank port 78 is open to this loop.

When seawater is to be pumped into the ballast tanks through ballast tank port 78, pilot hydraulic pressure is applied to cavity 92 shifting pilot pressure actuating piston 46 to the left. Therefore poppet valve 58 closes and poppet valve 60 opens. Also, pilot hydraulic pressure is applied to cavity 88 to keep poppet piston 44 to the left or neutral position, and the valve is now set as shown in FIG 2 so as to permit the ballast tanks to be filled by the sea water pump (not shown).

To deballast or to pump out the ballast tanks, cavity 86 is pressurized with pilot hydraulic pressure shifting the poppet piston 40 to the right which closes poppet valve 50, and opens poppet valve 48. The poppet piston 42 is held in the position to the right due to pilot pressure being applied to cavity 90. Flow then is from the ballast tanks through port 78 into internal conduit 80 and thence into sea water pump inlet port 82. The sea water pump outlet flows into port 74 and out through the ambient ocean port 72.

To free flood the ballast tanks and bypass the sea water pumps, hydraulic pilot pressure is applied to cavity 92 thus moving poppet piston 46 to the right and affecting a seal between seat 62 and poppet 52. Pilot pressure is also applied to poppet piston 44 from cavity 86. This moves spool 40 to the right until the end of poppet valve 50 contacts the end of poppet valve 58. Poppet piston 40 then maintains a position such that seawater can flow freely between poppet valve 48 and valve seat 54 and also between poppet valve 50 and seat 56. This permits free communication of seawater between the ambient ocean through port 72, between poppet valve 48 and seat 54, through conduit 76 and between poppet valve 50 and valve seat 56 and into conduit 78 leading to the ballast tanks. This actuation is possible because the area of actuating piston 46 is greater than the area of actuating piston 44. This unbalance will permit spool 42 to move to the left so that poppet valve 58 contacts valve seat 62. At the same time when spool 40 moves to the right, the end of its poppet valve 50 contacts the end of poppet valve 58 of spool 42. The valve is machined so that in this position, poppet valve 50 does not contact valve seat 56 and poppet valve 48 does not contact valve seat 54.

As is obvious from the above description and operation the valve according to this invention provides 5-way action having only 4-positions. Numerous modifications and variations of the present invention are possible in light of the above teachings. It is therefore to be understood that within the scope of the appended claims, the invention may be practiced otherwise than as specifically described.

What is claimed is:

1. A high pressure, 4-position, 5-way, pilot pressure operated valve for operation in a high pressure environment comprising:

a valve body having a plurality of inlet and outlet ports for the flow of high pressure fluid;

a pair of poppet pistons contained in sliding and sealing relationship within bores in said valve body;

each of said poppet pistons having a pilot pressure actuated piston centrally located thereon, one having a larger diameter than the other to provide a larger control force;

a valve poppet located at each end of each respective poppet piston;

said poppet pistons being co-axial within said body to contact one another, so that the one larger poppet piston, at one position, contacts and controls said other poppet piston, to prevent it from moving fully and sealing either of its poppet valves; and a pilot hydraulic fluid pressure cavity in said valve body on either side of each of said pilot pressure actuated pistons;

whereby each piston may be independently axially moved to provide 4-position, 5-way action in a high pressure pilot operated valve.

2. The pilot pressure operated valve of claim 1 wherein:

said pilot pressure actuated pistons are relatively large compared to their respective valve poppets; and said valve poppets at each end of said poppet pistons are tapered-type valves to provide operation with high pressure fluids.

3. The pilot pressure operated valve of claim 2 further comprising:

end plugs in each end of said body having a small bore for containing, in sliding and sealing relationship, one of each of said valve poppets.

4. The pilot pressure operated valve of claim 3 wherein:

each of said pilot pressure operated pistons and each of said valve poppets have O-rings for maintaining a sliding and sealing relationship with the bore in which they operate.

5. The pilot pressure operated valve of claim 4 wherein:

each of said valve poppets has an elastomeric seal material for providing a tight seal with the mating seat.

6. A multiple position valve for use in a high pressure environment comprising:

a valve body;

a plurality of ports in said body;

means for controlling the flow of fluid from a first ambient ocean port to a seawater pump inlet port;

second means for controlling the flow of fluid between a second ambient ocean port and a seawater pump outlet port;

third means for controlling the flow of fluid between said seawater pump inlet port and a ballast tank port;

a fourth means for controlling the flow of fluid between said seawater pump outlet port and said ballast tank port;

said first and third means including a first common actuation means;

said second and fourth means including a second common actuation means;

a fifth means for controlling the flow of fluid from said second ambient ocean port to said ballast tank port, when said first and said second actuation means are actuated in opposing directions.

* * * * *